US011148020B2

(12) United States Patent
Snyder

(10) Patent No.: US 11,148,020 B2
(45) **Date of Patent: *Oct. 19, 2021**

(54) IRON-TYPE GOLF CLUB HEADS WITH A DUAL-DENSITY INSERT

(71) Applicant: Karsten Manufacturing Corporation, Phoenix, AZ (US)

(72) Inventor: Jeremy N. Snyder, Benbrook, TX (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/914,010

(22) Filed: Jun. 26, 2020

(65) Prior Publication Data

US 2020/0324175 A1 Oct. 15, 2020

Related U.S. Application Data

(63) Continuation of application No. 16/431,619, filed on Jun. 4, 2019, now Pat. No. 10,695,627, which is a continuation of application No. 14/724,435, filed on May 28, 2015, now Pat. No. 10,335,651.

(51) Int. Cl.
*A63B 53/04* (2015.01)

(52) U.S. Cl.
CPC ..... *A63B 53/047* (2013.01); *A63B 53/0408* (2020.08); *A63B 2053/0491* (2013.01)

(58) Field of Classification Search
CPC ..... A63B 53/04; A63B 53/047; A63B 2053/0408; A63B 2053/0491
See application file for complete search history.

(56) References Cited

U.S. PATENT DOCUMENTS 2,846,228 A * 8/1958 Reach ..... A63B 53/04 473/332
4,355,808 A * 10/1982 Jernigan ..... A63B 53/04 473/324
5,048,835 A * 9/1991 Gorman ..... A63B 60/00 473/350
5,074,563 A * 12/1991 Gorman ..... A63B 53/04 473/350
5,290,036 A * 3/1994 Fenton ..... A63B 53/04 473/332
5,492,327 A * 2/1996 Biafore, Jr. ..... A63B 60/00 473/332
5,586,947 A * 12/1996 Hutin ..... A63B 53/047 473/324
5,707,302 A * 1/1998 Leon ..... A63B 53/04 473/324

(Continued)

*Primary Examiner* — William M Pierce

(57) ABSTRACT

In general, aspects of this invention relate to blade-type iron golf clubs or golf club heads. The blade-type golf club head may comprise a body forged of a metal material. The body may include a hosel, a top surface, a sole, a heel, a toe, a ball striking surface, and a rear surface opposite the ball striking surface. The rear surface may have recess in which a dual-density insert is affixed. The dual-density insert may have a first portion or first insert with a density greater than a second portion or second insert with a lesser density located closer to the toe than the first portion or first insert located closer to the heel. The mass distribution of the dual-density insert moves the center of gravity of the club head closer or substantially coincident to the face center location.

20 Claims, 18 Drawing Sheets

(56) References Cited

U.S. PATENT DOCUMENTS 5,800,282 A * 9/1998 Hutin ..... A63B 60/02 473/291
5,816,936 A * 10/1998 Aizawa ..... A63B 53/047 473/342
6,027,415 A * 2/2000 Takeda ..... A63B 53/047 473/291
6,086,485 A * 7/2000 Hamada ..... A63B 53/04 473/329
6,193,614 B1 * 2/2001 Sasamoto ..... A63B 60/46 473/329
6,290,609 B1 * 9/2001 Takeda ..... A63B 53/047 473/335
6,368,231 B1 * 4/2002 Chen ..... A63B 53/04 473/329
6,592,469 B2 * 7/2003 Gilbert ..... A63B 60/00 473/350
6,811,496 B2 * 11/2004 Wahl ..... A63B 53/047 473/334
7,186,188 B2 * 3/2007 Gilbert ..... A63B 53/047 473/290
7,192,362 B2 * 3/2007 Gilbert ..... A63B 53/00 473/291
7,614,962 B1 * 11/2009 Clausen ..... A63B 53/047 473/291
7,621,822 B2 * 11/2009 Roach ..... A63B 60/02 473/329
7,789,771 B2 * 9/2010 Park ..... A63B 60/52 473/332
7,803,062 B2 * 9/2010 Gilbert ..... A63B 53/0475 473/290
7,892,106 B2 * 2/2011 Matsunaga ..... A63B 53/047 473/290
8,366,566 B1 * 2/2013 Rollinson ..... A63B 53/047 473/332
8,403,771 B1 * 3/2013 Rice ..... A63B 53/0466 473/328
8,834,292 B2 * 9/2014 Tsuji ..... A63B 60/00 473/332
8,911,301 B1 * 12/2014 Allen ..... A63B 53/047 473/329
8,911,302 B1 * 12/2014 Ivanova ..... A63B 60/00 473/329
9,039,543 B2 * 5/2015 Mizutani ..... A63B 60/54 473/332
2005/0037864 A1 * 2/2005 Gilbert ..... A63B 53/047 473/349
2008/0015051 A1 * 1/2008 Roach ..... A63B 60/02 473/350
2008/0058119 A1 * 3/2008 Soracco ..... A63B 53/047 473/350
2008/0102982 A1 * 5/2008 Wahl ..... A63B 60/00 473/335
2011/0207551 A1 * 8/2011 Breier ..... A63B 53/047 473/332
2013/0281227 A1 * 10/2013 Roach ..... A63B 53/047 473/332
2013/0331201 A1 * 12/2013 Wahl ..... A63B 53/047 473/329
2013/0344988 A1 * 12/2013 Hettinger ..... A63B 60/00 473/349
2013/0344989 A1 * 12/2013 Hebreo ..... A63B 60/02 473/349
2014/0274441 A1 * 9/2014 Greer ..... A63B 60/42 473/290
2015/0328506 A1 * 11/2015 Morales ..... A63B 53/047 473/331
2016/0144248 A1 * 5/2016 Chen ..... A63B 53/047 473/350
2016/0193511 A1 * 7/2016 Greer ..... A63B 53/047 473/290
2016/0332044 A1 * 11/2016 Daraskavich ..... A63B 53/0475
2016/0367876 A1 * 12/2016 Taylor ..... A63B 60/54

* cited by examiner

| Player | Club | Face Ht | CoF Ht | CG Ht | Impact Face Ht | CFX | CGX | Impact X |
|---|---|---|---|---|---|---|---|---|
| Pro Player 1 | 5 | 1.960 | 0.861 | 0.748 | 0.604 | 1.178 | 1.150 | 1.187 |
| | 9 | 1.791 | 0.865 | 0.743 | 0.714 | 1.217 | 1.179 | 1.236 |

FIG. 12

| Player | Club | Face Ht | CoF Ht | CG Ht | Impact Face Ht | CFX | CGX | Impact X |
|---|---|---|---|---|---|---|---|---|
| Pro Player 2 | 5 | 1.931 | 0.863 | 0.734 | 0.640 | 1.193 | 1.126 | 1.230 |
| | 9 | 1.748 | 0.872 | 0.734 | 0.531 | 1.255 | 1.181 | 1.426 |

FIG. 14

| Player | Club | Face Ht | CoF Ht | CG Ht | Impact Face Ht | CFX | CGX | Impact X |
|---|---|---|---|---|---|---|---|---|
| Pro Player 3 | 5 | 1.885 | 0.848 | 0.773 | 0.597 | 1.205 | 1.144 | 1.438 |
| | 9 | 1.728 | 0.873 | 0.725 | 0.590 | 1.271 | 1.256 | 1.440 |

FIG. 16

IRON-TYPE GOLF CLUB HEADS WITH A DUAL-DENSITY INSERT

This is a continuation of U.S. patent application Ser. No. 16/431,619 filed on Jun. 4, 2019, and issued as U.S. Pat. No. 10,695,627 on Jun. 30, 2020, which is a continuation of U.S. patent application Ser. No. 14/724,435 filed May 28, 2015, and issued as U.S. Pat. No. 10,335,661 on Jul. 2, 2019, all of which above are fully incorporated herein by reference.

FIELD OF THE INVENTION

This invention relates generally to golf clubs and golf club heads, and more particularly blade iron golf clubs having one or more dual-density inserts located within a recess behind a point-of-impact region of a ball striking surface.

BACKGROUND

Golf clubs are well known in the art for use in the game of golf Iron type golf clubs generally either have a cavity back configuration or a muscle-back or blade-type configuration. Amateur golfers generally prefer cavity back perimeter-weighted clubs and find these clubs are easier to hit. Blade type irons are generally preferred by professional golfers and other golfers with considerable skill levels because these irons provide better feel when a golf ball is struck squarely.

Cavity-back iron type club heads, also known as perimeter weighted irons, are known to have a concentration of mass about the periphery of a rear surface of the club head. This concentration of mass is in a raised, rib-like, perimeter weighting element that substantially surrounds a rear cavity, which comprises a major portion of the rear surface of the club head. In addition to locating a substantial amount of mass away from the center of the club head behind the club face, the rib-like perimeter weighting element acts as a structural stiffener, which compensates for reduction in face thickness in the cavity region.

Muscle-back or blade irons are characterized by a thick lower portion known as the "muscle", which extends along the entire length of the head. A thin upper portion extends upwardly from the muscle and behind the face of the club, and is commonly referred to as the blade portion. The blade portion has no reinforcement ribs or perimeter weighting, with the only concentration of mass being in the muscle of the club extending along the sole and the entire length of the club head. Typically, a muscle-back club head is smaller than a cavity-back head, due to the solid muscle portion having substantial mass. This configuration provides excellent feel when a ball is struck at the sweet spot, but typically yields a harsher sensation as well as greater distance loss associated with off-center shots in comparison to similar shots hit with cavity-back irons. For these reasons, muscle-back clubs are generally better suited to skilled golfers who consistently strike the ball within close proximity of the sweet spot. Muscle-back clubs therefore are more difficult to hit, but provide skilled golfers with desired control and shot shaping ability, or workability.

Generally, muscle-back or blade irons have a center of gravity located away from the face center location. For conventional blade-type irons, the center of gravity of the club head is located on the heel and sole side of the face center location. It is generally understood that the closer the center of gravity of the club head is to the face center, the better the club will feel and perform at impact when hitting the golf ball on the face center location.

The present invention seeks to overcome these limitations and other drawbacks of known muscle-back or blade iron golf clubs and golf club heads.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

According to aspects of this invention, an iron-type golf club head may comprise a top surface, a sole, a heel, and a toe. The iron-type golf club head may be a blade-type iron golf club head further defined with the top surface having a width of no greater than 7 mm and the sole having a width of no greater than 16 mm. The iron-type golf club head may further comprise a ball striking surface configured for striking a ball. The ball striking surface may have a ball striking area that defines a heel-side boundary line, a toe-side boundary line and a ball striking centerline. The iron-type golf club head may further comprise a rear surface opposite the ball striking surface. The rear surface may have a separate upper blade portion and a lower muscle portion. The upper blade portion may be separated from the lower muscle portion by a blade interface. The upper blade portion and the lower muscle portion may extend across the rear surface from the heel to the toe. The upper blade portion may extend from the top surface to the blade interface. The lower muscle portion may extend from the blade interface to the sole. Additionally, the upper blade portion may have a generally uniform thickness from the heel to the toe which is between approximately 6 mm and 8 mm. The lower muscle portion may have a thickness greater than the upper blade portion thickness. The lower muscle portion thickness may be between approximately 8 mm and 16 mm.

Additional aspects of this invention relate to a blade-type iron golf club head. The blade-type golf club head may comprise a ball striking surface and a rear surface opposite the ball striking surface. The ball striking surface may be configured for striking a ball. The ball striking surface may have a ball striking area that defines a heel-side boundary line, a toe-side boundary line and a ball striking centerline. The ball striking device further includes one or more inserts located behind the rear surface. In one particular aspect, a first insert may be located behind and affixed to the rear surface of the ball striking surface with an adhesive member. According to certain aspects, the adhesive member may cover substantially the entire interior surface of the insert, i.e., the surface that faces the rear surface of the ball striking surface.

According to some aspects, the insert may include two separate regions of different densities. The first region may consist of a material with a greater density and is located behind the ball striking face and closer to the heel. Additionally, or alternatively, the second region may consist of a material with a lesser density than the first region and is located behind the ball striking face and closer to the toe.

According to some aspects, the ball striking surface has a frame extending rearwardly from the perimeter and the first insert may be located within a recess encompassed by the frame. When viewed from the back of the ball striking device, the insert may extend across the opening of the recess.

The ball striking surface may be incorporated into a body to thereby form a golf club head and the body may be configured for engagement to a shaft to thereby form a golf club. In particular, an iron-type golf club head may be formed. A shaft may be engaged with the golf club head to form a golf club.

BRIEF DESCRIPTION OF THE DRAWINGS

To allow for a more full understanding of the present invention, it will now be described by way of example, with reference to the following drawings.

FIG. 12 illustrates a table summarizing the dimensional measurements for exemplary golf clubs by an exemplary professional golfer utilizing a prior art golf club;

FIG. 14 illustrates a table summarizing the dimensional measurements for exemplary golf clubs by another exemplary professional golfer utilizing a prior art golf club;

FIG. 16 illustrates a table summarizing the dimensional measurements for exemplary golf clubs by another exemplary professional golfer utilizing a prior art golf club;

Figure 1:
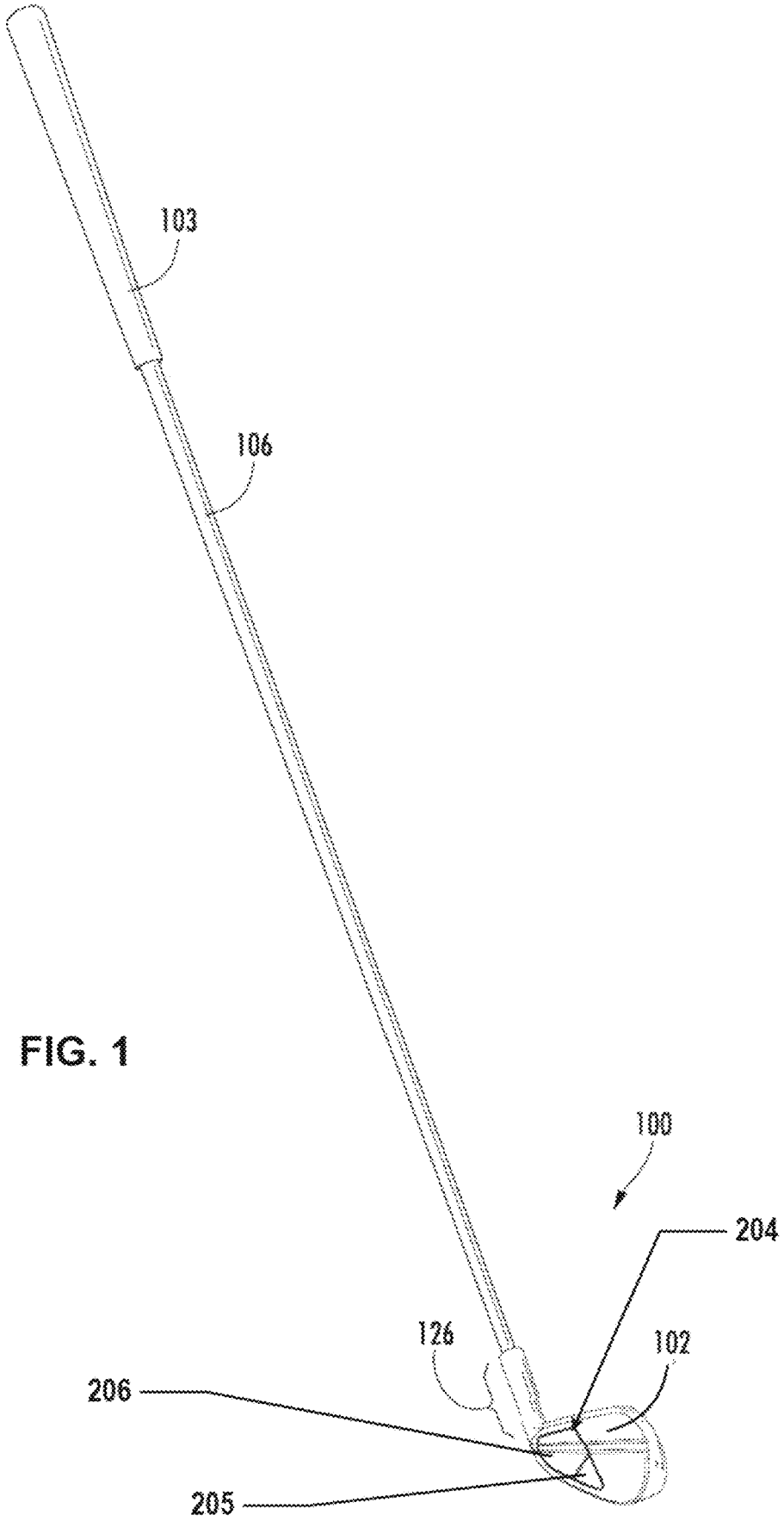
FIG. 1 generally illustrates a perspective view of an example golf club according to this invention.

The various figures in this application illustrate examples of ball striking devices and portions thereof according to this invention. The figures referred to above are not necessarily drawn to scale, should be understood to provide a representation of particular embodiments of the invention, and are merely conceptual in nature and illustrative of the principles involved. Some features of the ball striking devices depicted in the drawings may have been enlarged or distorted relative to others to facilitate explanation and understanding. When the same reference number appears in more than one drawing, that reference number is used consistently in this specification and the drawings to refer to similar or identical components and features shown in the various alternative embodiments.

DETAILED DESCRIPTION

In the following description of various example structures in accordance with the invention, reference is made to the accompanying drawings, which form a part hereof, and in which are shown by way of illustration various example adjustment members, golf club heads, and golf club structures in accordance with the invention. Additionally, it is to be understood that other specific arrangements of parts and structures may be utilized and structural and functional modifications may be made without departing from the scope of the present invention. Also, while the terms "top," "bottom," "front," "back," "rear," "side," "underside," "overhead," and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of this invention.

A. General Description of Muscle-Back or Blade-Type Iron Clubs and Club Heads

Figure 2A:
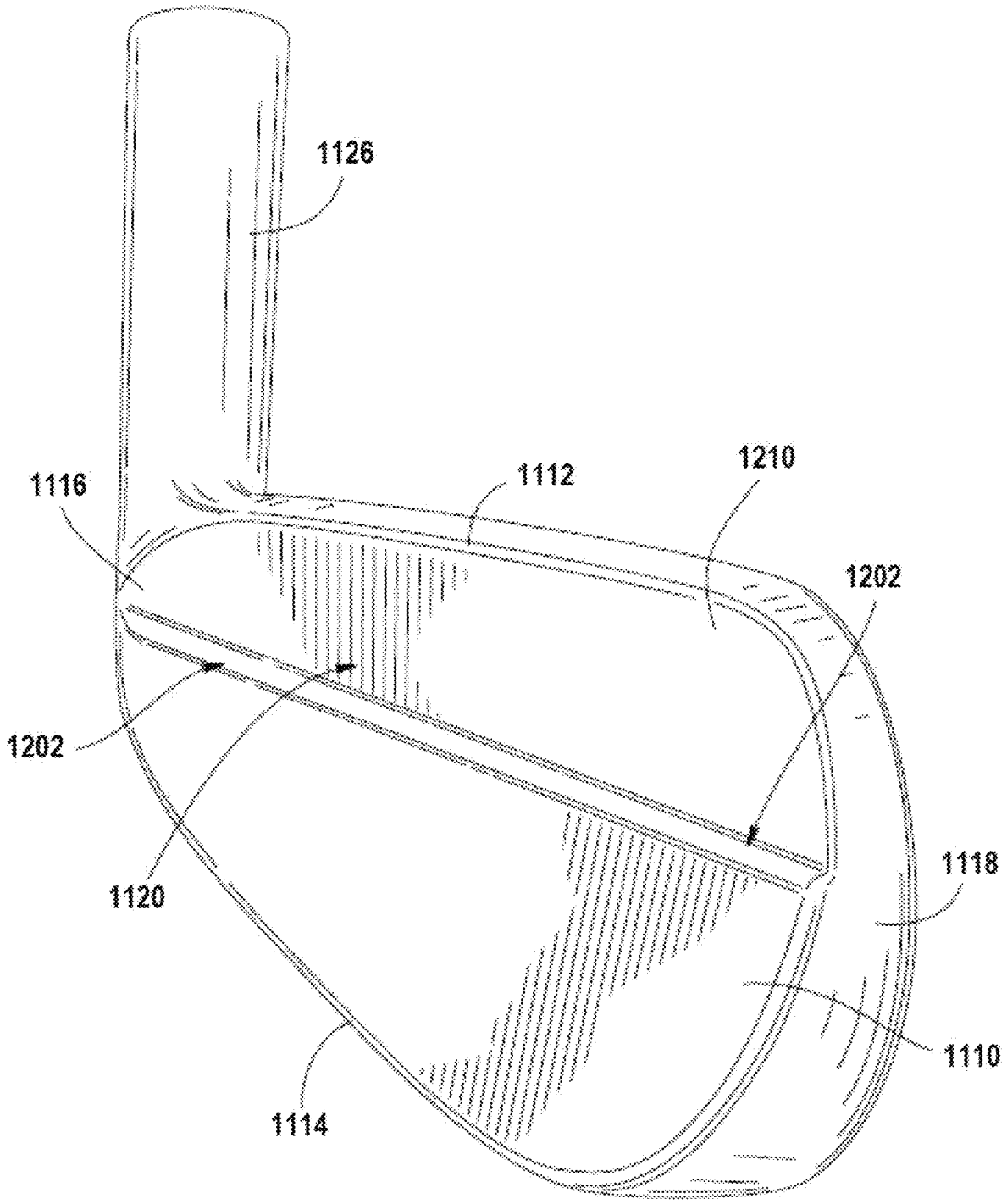
FIG. 2A PRIOR ART
FIG. 2A generally illustrates a perspective rear view of a prior art golf club head.
Figure 2B:
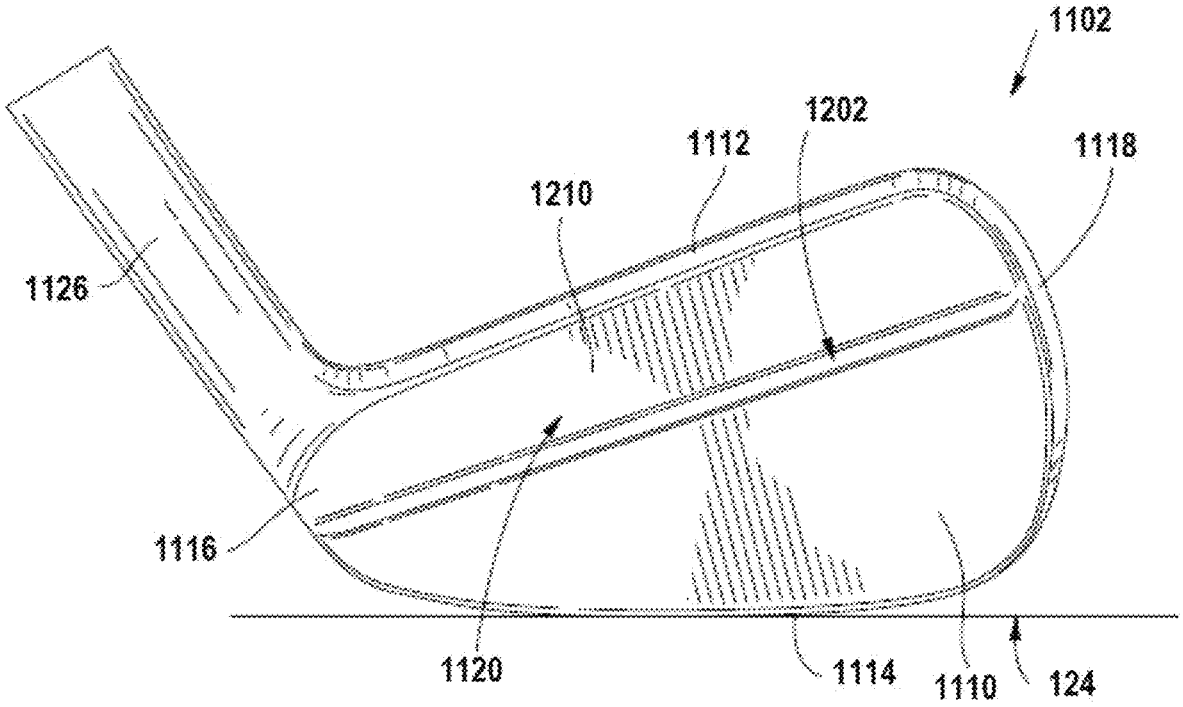
FIG. 2B PRIOR ART
FIG. 2B generally illustrates a rear view of the prior art golf club head of FIG. 2A.

In general, aspects of this invention relate to a set of golf clubs, golf clubs, or golf club heads with a blade-type golf club head. FIG. 1 illustrates an example blade-type golf club head in accordance with aspects of this invention. Generally, a blade-type golf club head does not contain any cavities or depressions in the rear surface as distinguished from perimeter-weighted clubs which contain one or more rear cavities. FIGS. 2A and 2B illustrate a prior art golf club head, shown having a traditional muscle-back or blade-type iron configuration. The iron club head 1102 in FIGS. 2A and 2B includes a face or striking face 1110, a top surface 1112, a sole 1114, a heel 1116, a toe 1118, and a rear surface 1120 as was described above. The rear surface 1120 comprises a substantially flat area, which defines a blade portion 1210 of the club head, and a contoured area which defines a muscle portion 1220 of the club head 1102. The blade portion 1210 generally occupies the entire upper portion of the club head 1102, and has a substantially constant thickness that may be less than, for example, about 6.4 mm. The muscle portion 1220 generally constitutes a lower portion of the club head 1102, and has a varying thickness that is everywhere greater than that of blade portion 1210.

The muscle portion 1220 may be generally separated from the upper blade portion 1210 by a blade interface 1202, represented by a phantom line. The blade interface 1202 may be a smooth, arcuate surface forming the transition area between the upper blade portion 1210 and the muscle portion 1220. If there is no distinct boundary separating the muscle portion 1220 and the upper blade portion 1210, the transition between the muscle portion 1220 and the upper blade portion 1210 may occur via a gradual surface curvature. As illustrated in FIGS. 2A and 2B, the blade interface 1202 is a straight line extending across the rear surface 1120 of the club head 1102 from the heel 1116 to the toe 1118.

Additionally, other features and characteristics may be identified with a blade-type or muscle-back iron club head. The blade-type or muscle-back iron club head may be formed of forged metal such as carbon steel in order to increase the feel provided to the golfer. Additionally, the sole width of a blade-type or muscle-back iron club head may be generally thin and constant along the length of the sole. For example, the sole width for blade-type or muscle-back iron club heads may be approximately 9.5 mm to 15.9 mm in width. Additionally, the top surface width or blade width (also known as top-line width) may be generally constant along the length of the top surface. For example, the top surface width for blade-type or muscle-back iron club heads may be approximately 3.2 mm to 6.4 mm in width. Additionally, the hosel length of blade-type or muscle-back iron club heads may be approximately 50 mm to 75 mm in length from the ground 124 to the top of the hosel 126. Generally, the top lines on a blade-type or muscle-back iron club head are thin and set. For example, the top view from a reference position, a golfer looking down on the club head can see only the thin top surface 112 and the striking face 110, with none of the rear surface 120 is visible.

FIGS. 11 through 17B illustrate prior art blade-type or muscle-back iron club heads. FIGS. 11 through 17B are illustrated to show the dimensional measurements for three example professional players and their impact location on the striking face of the prior art golf club head with respect to the face center location of the striking face and the location of the center of gravity of the prior art golf club head. These figures and tables illustrate the discrepancy between the impact locations, the center of gravity location, and the face center location, even for professional golfers.

Figure 11:
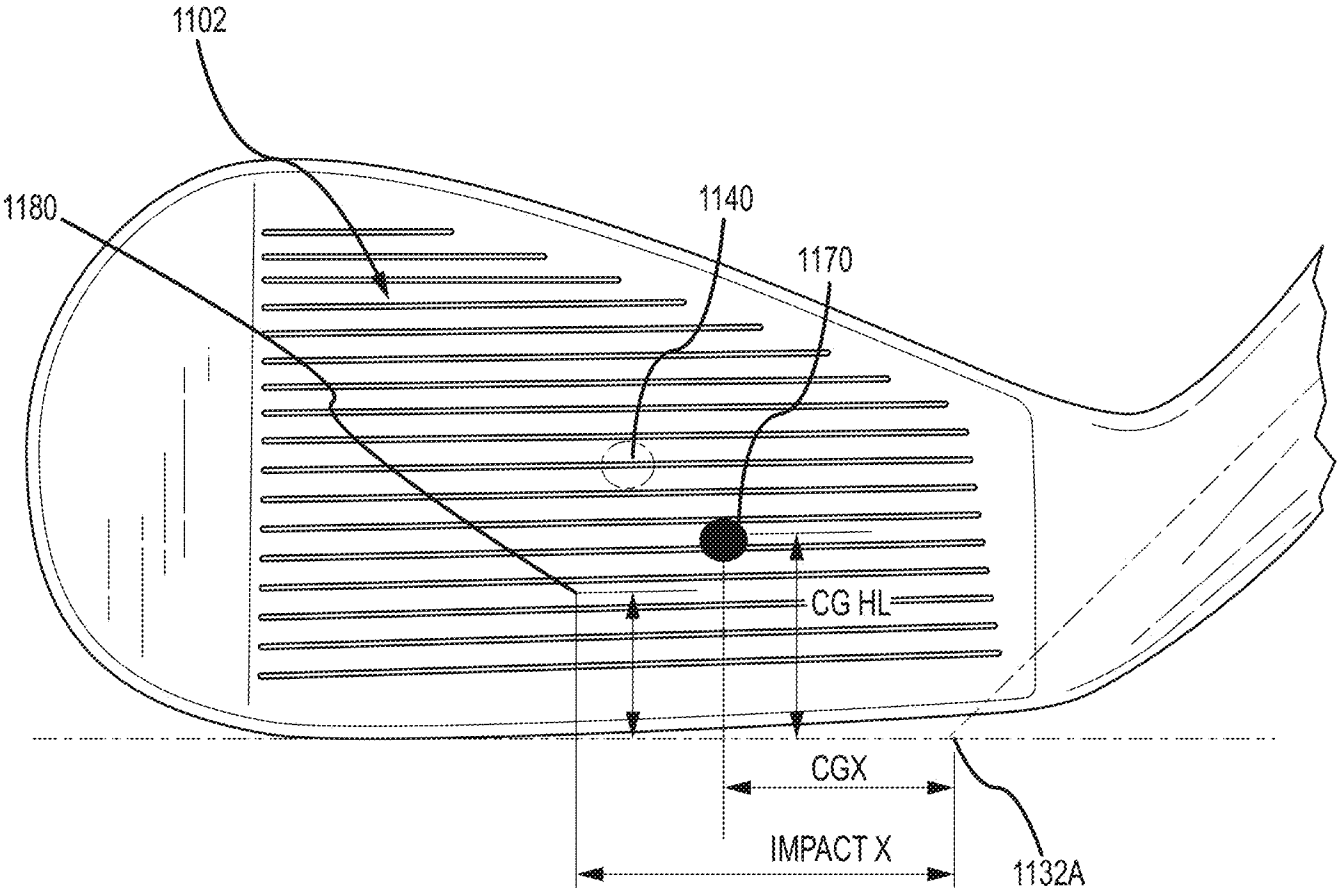
FIG. 11 illustrates a front view of an iron-type golf club head illustrating the dimensional measurements of a face center location, an impact location, and a center of gravity location of the golf club head.
Figure 13A:
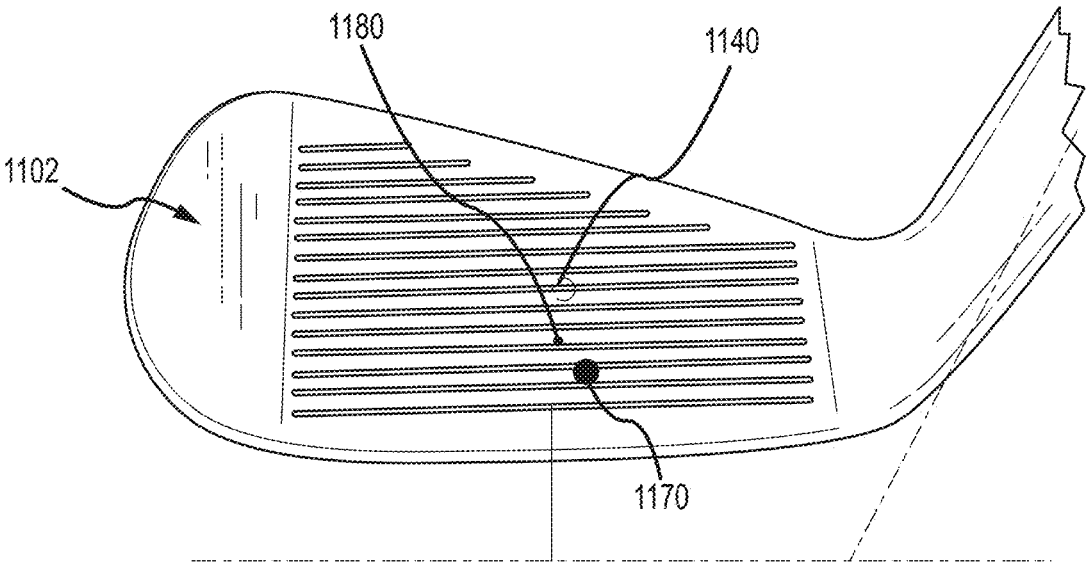
FIGS. 13A and 13B illustrate an example striking face and the dimensional measurements for exemplary golf clubs listed in the table from FIG. 12.
Figure 13B:
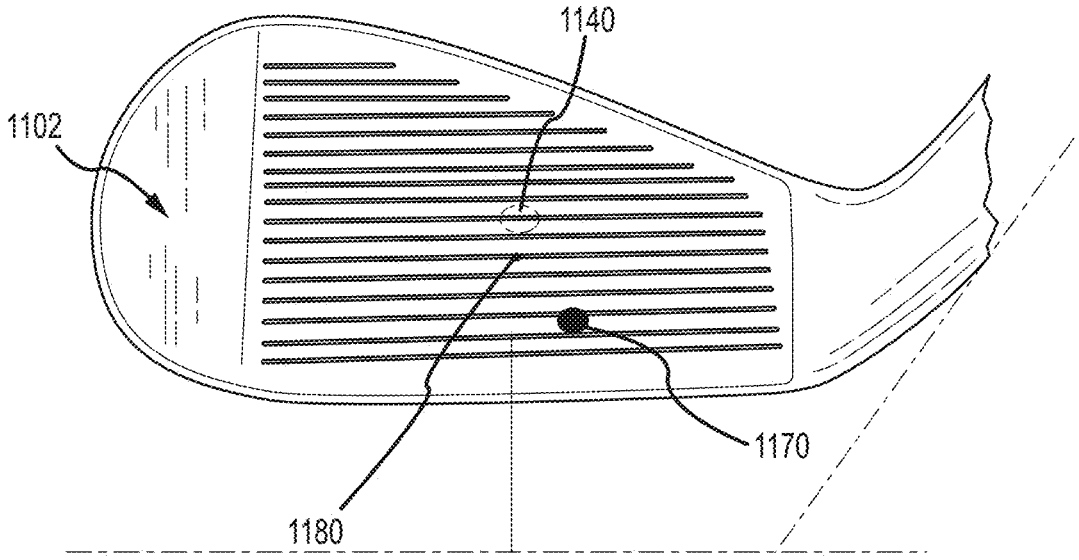
Figure 15A:
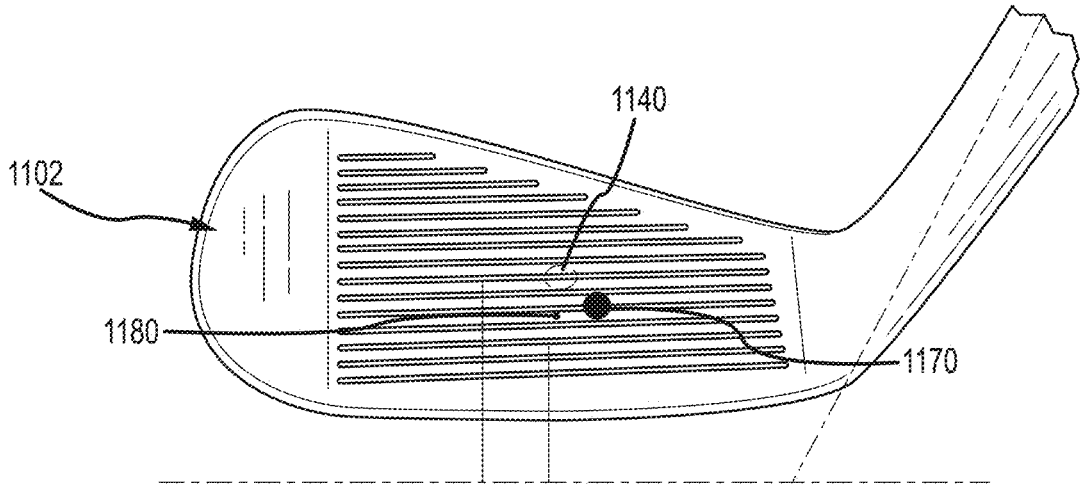
FIGS. 15A and 15B illustrate an example striking face and the dimensional measurements for the exemplary golf clubs listed in the table from FIG. 14.
Figure 15B:
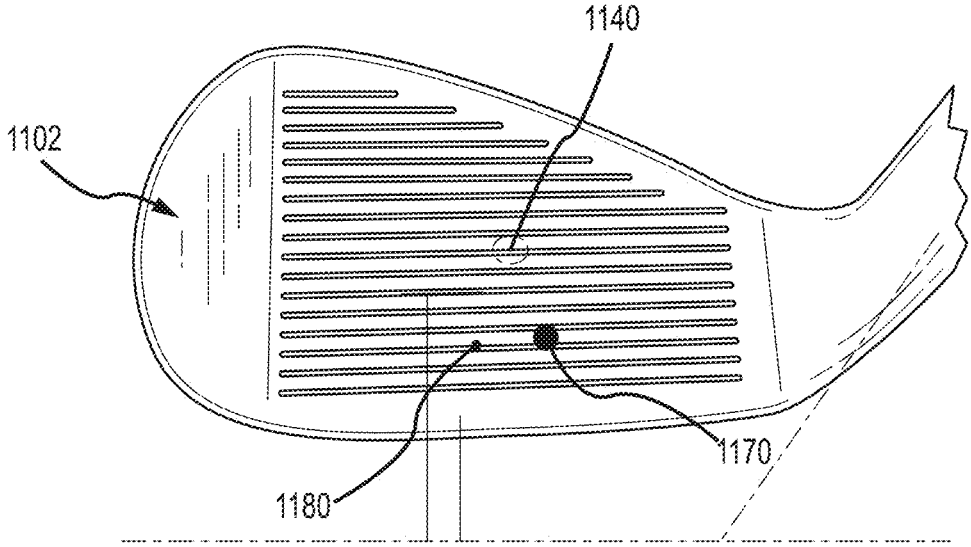
Figure 17A:
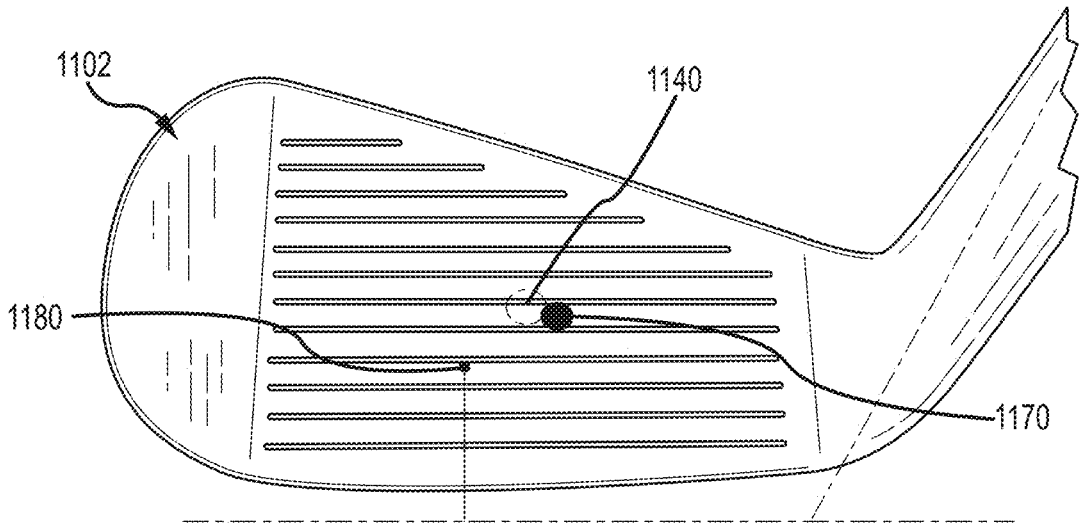
FIGS. 17A and 17B illustrate example striking faces and the dimensional measurements for the exemplary golf clubs listed in the table from FIG. 16.
Figure 17B:
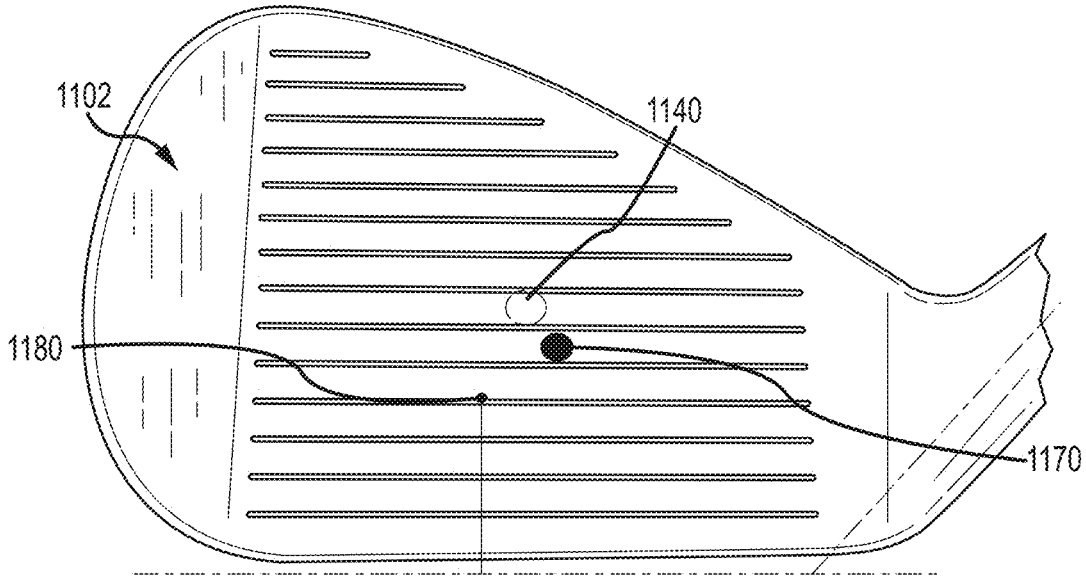

Specifically, FIG. 11 illustrates an iron-type golf club head illustrating how the dimensional measurements of a face center location 1140, an impact location, and a center of gravity location of the golf club head are taken with respect to a ground origin point as is defined below and shown in FIG. 4 (reference number 132B). FIGS. 12, 13A, and 13B illustrate the dimensional measurements for first exemplary golf clubs utilized by a first exemplary professional golfer utilizing a first prior art blade-type or muscle-blade-type golf club head. FIG. 12 illustrates a table summarizing the dimensional measurements for the first exemplary golf clubs by the first exemplary professional golfer utilizing the first prior art golf clubs and FIGS. 13A and 13B illustrate an example striking face and the dimensional measurements for each of the striking faces from the exemplary golf clubs listed in the table from FIG. 12. FIGS. 14, 15A, and 15B illustrate the dimensional measurements for second exemplary golf clubs utilized by a second exemplary professional golfer utilizing a second prior art blade-type or muscle-blade-type golf club head. FIG. 14 illustrates a table summarizing the dimensional measurements for the second exemplary golf clubs by the second exemplary professional golfer utilizing the second prior art golf clubs and FIGS. 15A and 15B illustrate an example striking face and the dimensional measurements for each of the striking faces from the second exemplary golf clubs listed in the table from FIG. 14. FIGS. 16, 17A, and 17B illustrate the dimensional measurements for a third exemplary golf clubs utilized by a third exemplary professional golfer utilizing a third prior art blade-type or muscle-blade-type golf club head. FIG. 16 illustrates a table summarizing the dimensional measurements for the third exemplary golf clubs by the third exemplary professional golfer utilizing the third prior art golf clubs and FIGS. 17A and 17B illustrate an example striking face and the dimensional measurements for each of the striking faces from the third exemplary golf clubs listed in the table from FIG. 16.

As illustrated in FIGS. 11-17B, a golf club head 1102 may include a face center location 1140, a center of gravity location 1170, and an impact location 1180. Each of the face center location 1140, the center of gravity location 1170, and impact location 1180 may include an x-direction coordinate and a height or z-direction coordinate. The x-direction coordinate and the height or z-direction coordinate may be measured from the ground origin point 1132A (as will be defined below and illustrated in FIG. 4).

B. Description of Muscle-Back or Blade-Type Iron Clubs and Club Heads in Accordance with Examples of this Invention FIG. 1 generally illustrates an example muscle-back or blade-type iron golf club 100 in accordance with at least some examples of this invention. This club 100 includes a club head 102, a shaft 106 (which will be described in more detail below), and a grip member 103 engaged with the shaft 106. While a low loft iron golf club head 102 is illustrated in these figures, aspects of this invention may be applied to any type of iron club head, including, for example: low, middle, and high loft club heads (of any desired loft, e.g., 1-iron, 2-iron, 3-iron, etc. to 9-iron and wedges with loft angles ranging from 20-64 degrees). The iron club heads may be made from any desired materials, in any desired construction and/or in any desired manner, including from conventional materials, in conventional constructions, in conventional manners, as are known and/or used in the art, optionally modified (if necessary, e.g., in size, shape, inclusion of structures, etc.) as required for aspects of this invention as described in more detail below.

Any desired materials also may be used for the shaft 106, including conventional materials that are known and/or used in the art, such as steel, graphite based materials, polymers, composite materials, combinations of these materials, etc. Optionally, if necessary or desired, the shaft 106 may be modified (e.g., in size, shape, etc.) to accommodate releasable club head/shaft connection parts. The grip member 103 may be engaged with the shaft 106 in any desired manner, including in conventional manners that are known and/or used in the art (e.g., via cements or adhesives, via mechanical connections, etc.). Any desired materials may be used for the grip member 103, including conventional materials that are known and/or used in the art, such as rubber, polymeric materials, cork, rubber or polymeric materials with cord or other fabric elements embedded therein, cloth or fabric, tape, etc.

Figure 3:
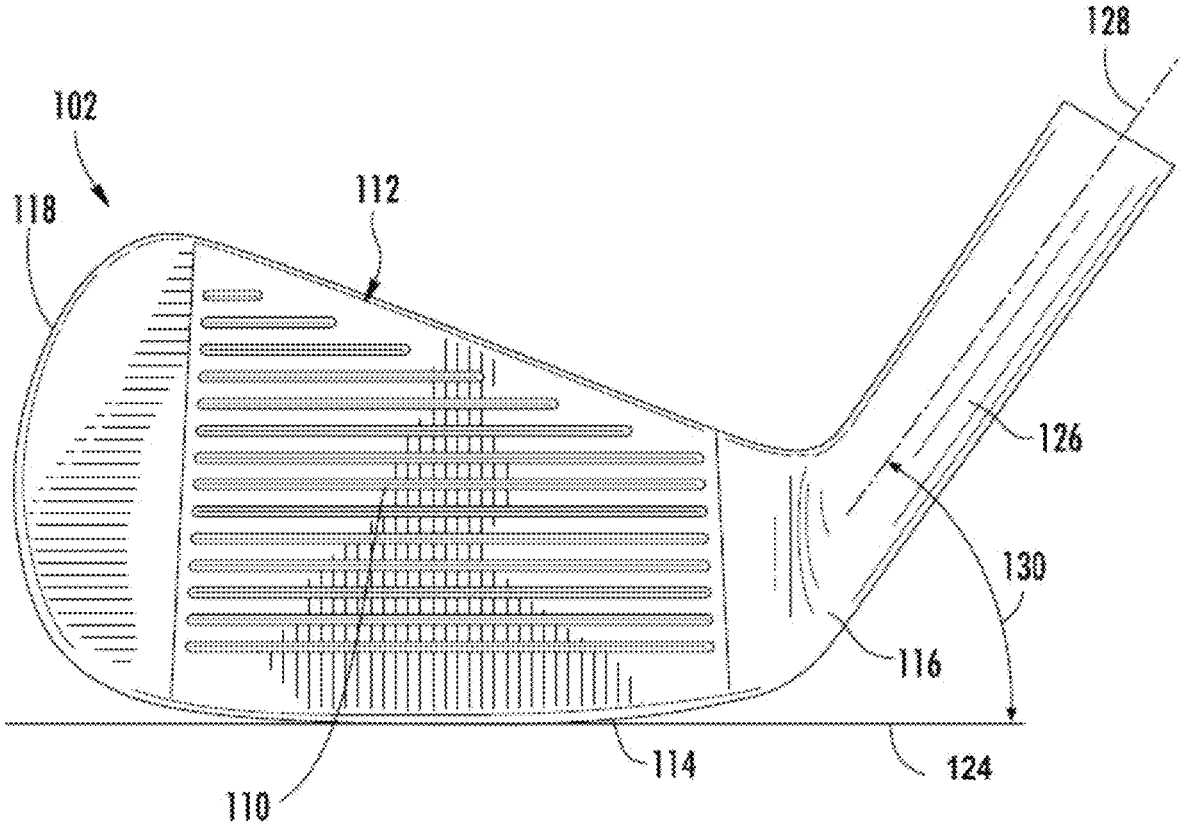
FIGS. 3 through 7B generally illustrate various views of an example golf club head and various performance parameters and characteristics according to this invention.

Generally, all iron club heads 102 include various parts. FIG. 3 illustrates various parts of the golf club head 102 as will be referenced throughout the remainder of this application (as referenced from USGA Rules of Golf). An iron club head 102 has a face or striking face 110, a top surface 112, a sole 114, a heel 116, a toe 118, and a rear surface 120 opposite the striking face 110. The top surface 112 may be defined as the upper portion of the head 102. The sole 114 may be defined as the bottom or underside portion of the head 102, and is generally opposite the top surface 112. The sole 114 may include an area on the club head 102 that rests on the ground when a golfer soles the golf club 100. The sole 114 may generally rest on a ground plane 124, wherein the ground plane 124 is a horizontal plane tangent with the bottom of the club head 102. The heel 116 may the part of the club head 102 nearer to and including a hosel 126. The toe 118 may be the area of the golf club 100 that is the farthest from the shaft 106. The rear surface 120 of the club head 102 is generally opposite the face 110. The shaft 106 attaches to the head 102 at the heel 116 via a hosel 126. The shaft 106 has a center axis. The hosel 126 may have a bore for receiving the shaft 106, or a shaft adapter (not shown). The hosel bore has a center axis or a hosel axis 128. If the shaft 106 is inserted and attached directly to hosel bore, the hosel axis 128 may be substantially coincident with shaft axis. For club configurations including a shaft adapter, the shaft 106 may be received in a shaft adapter bore. The shaft adapter bore may have a center axis or shaft adapter axis, which may be substantially coincident with shaft axis. The shaft adapter axis may be offset angularly and/or linearly from the hosel axis 128 to permit adjustment of club parameters via rotation of the shaft adapter with respect to club head 102, as is known by persons skilled in the art.

According to aspects of this invention, a golf club 100 may be oriented in a reference position. In the reference position, the golf club 100 may include a number of parameters or characteristics that may include, but are not limited to: a face center location, a loft angle, a face angle, a lie angle, and a center of gravity location. Parameters or characteristics as well as methods and procedures for measuring them will be described and detailed below.

As illustrated in FIG. 3, a lie angle 130 is defined as the angle formed between the shaft axis or hosel axis 128 and a horizontal plane contacting the sole 114, which may be the ground plane 124.

Figure 4:
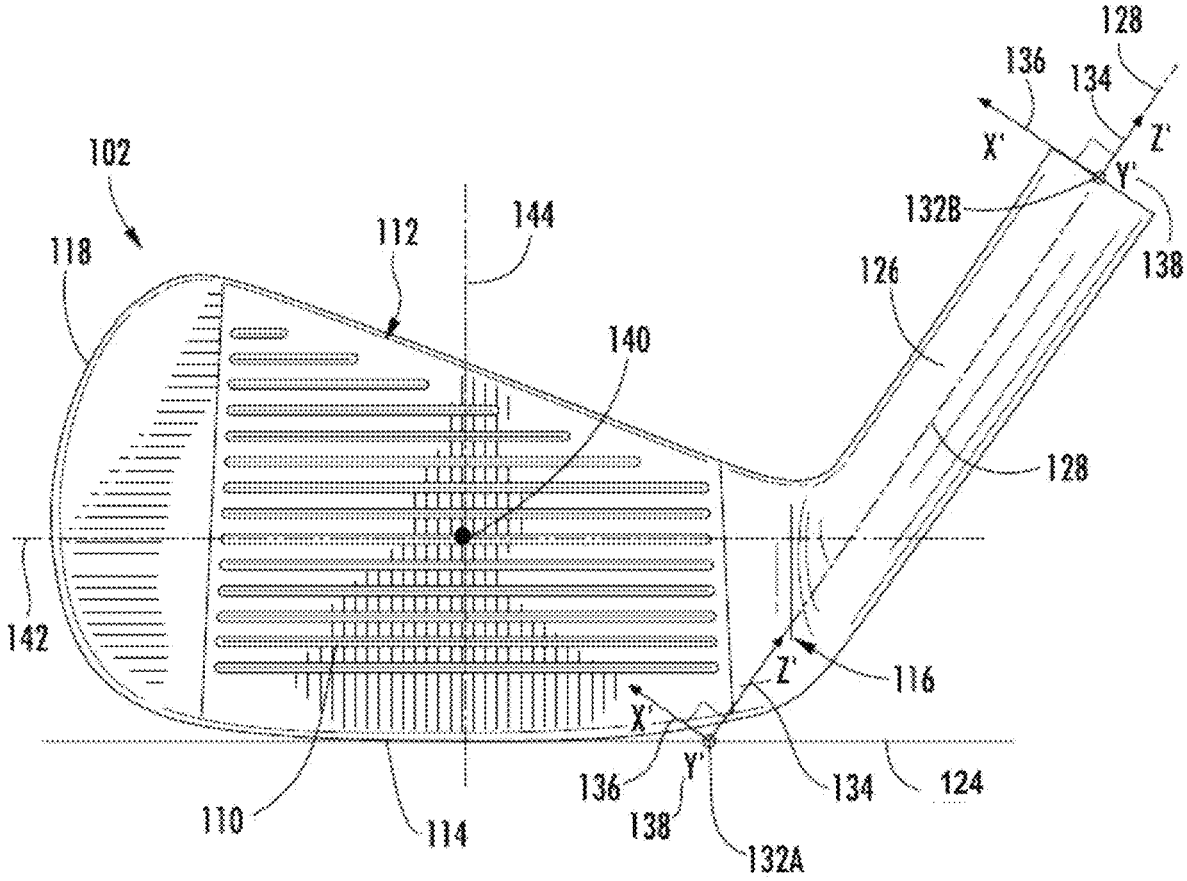

FIG. 4 illustrates the face center location 140 on a fixtured club head 102. The face center 140 is determined using Unites States Golf Association (USGA) standard measuring procedures and methods. For example, the current USGA procedure requires finding the center point along a horizontal line 142 along the club face 110 until the heel 116 and the toe 118 measurements at the edges of the face 110 of the club head 102 are equal. Then, finding the center point along a vertical line 144 along the club face 110 until the upper portion 112 and the sole 114 measurements at the edges of the face 110 of the club head 102 are also equal. When the heel 116 and the toe 118 measurements are equal and the upper portion 112 and the sole 114 measurements are equal, the intersecting point of these lines is defined as the face center location 140. Note: for irons, the heel and toe measurement is made at the edges of the roughened area of the face.

Figure 5:
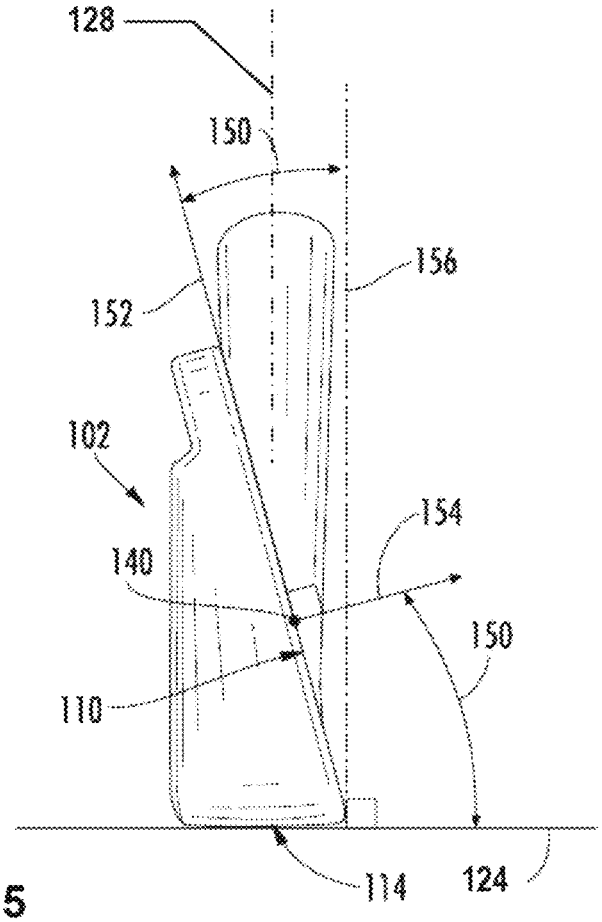

FIG. 5 illustrates an example of a loft angle 150 of the golf club head 102. As illustrated in FIG. 5, the loft angle 150 is defined as a measurement between an axis normal 152 or perpendicular to a face center axis 154 and an axis normal 156 or perpendicular to the ground plane 124. The face center axis 154 is defined as the axis from the face center 140 and normal to the face. Additionally, the loft angle 150 may be defined as a measurement between the face center axis 154 and the ground plane 124. It is recognized that each of these loft angle 150 definitions may yield a similar or exactly the same loft angle measurement.

Figure 6:
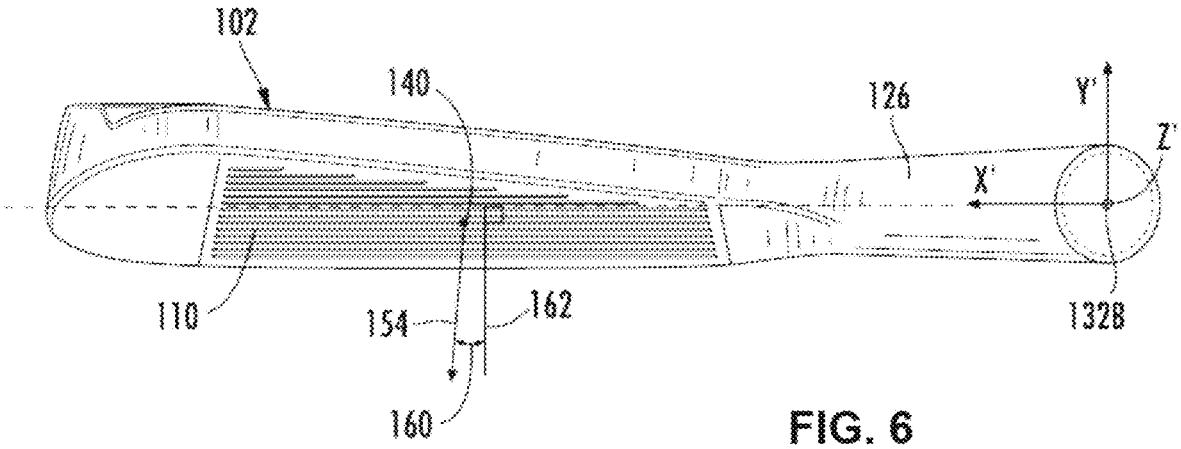

FIG. 6 illustrates an example of a face angle 160 of a golf club head 102. As illustrated in FIG. 6, the face angle 160 is measured by utilizing the face center axis 154 and a right plane 162 (a plane perpendicular to the X axis).

An origin point 132 may be defined on the golf club 100 or golf club head 102, or a point defined in relation to certain elements of the club or head. Various other points, such as the center of gravity, sole contact, and face center, may be described and/or measured in relation to the origin point 132. As illustrated in FIG. 4, a coordinate system may be defined on the origin point 132, e.g., with a Z' axis 134 extending along the direction of the shaft axis 107 (and/or the hosel axis 128), an X' axis 136 parallel with the vertical plane and normal to the Z' axis, and a Y' axis 138 normal to the X' and Z' axes.

FIG. 4 illustrates two different examples of where the origin point 132 may be located. A first location 132A, defined as a ground origin point 132A, is generally located at the ground plane 124. The ground origin point 132A is defined as the point at which the ground plane 124 and the hosel axis 128 intersect. The second location 132B, defined as the hosel origin point 132B, is generally located on the hosel 126. The hosel origin point 132B is located on the hosel axis 128 and coincident with the uppermost edge 126B of the hosel 126. Either location for the origin point 132 may be utilized without departing from this invention. Additionally, other locations for the origin point 132 may be utilized without departing from this invention. Throughout the remainder of this application, the ground origin point 132A will be utilized for all reference locations, tolerances, and calculations.

Figure 7A:
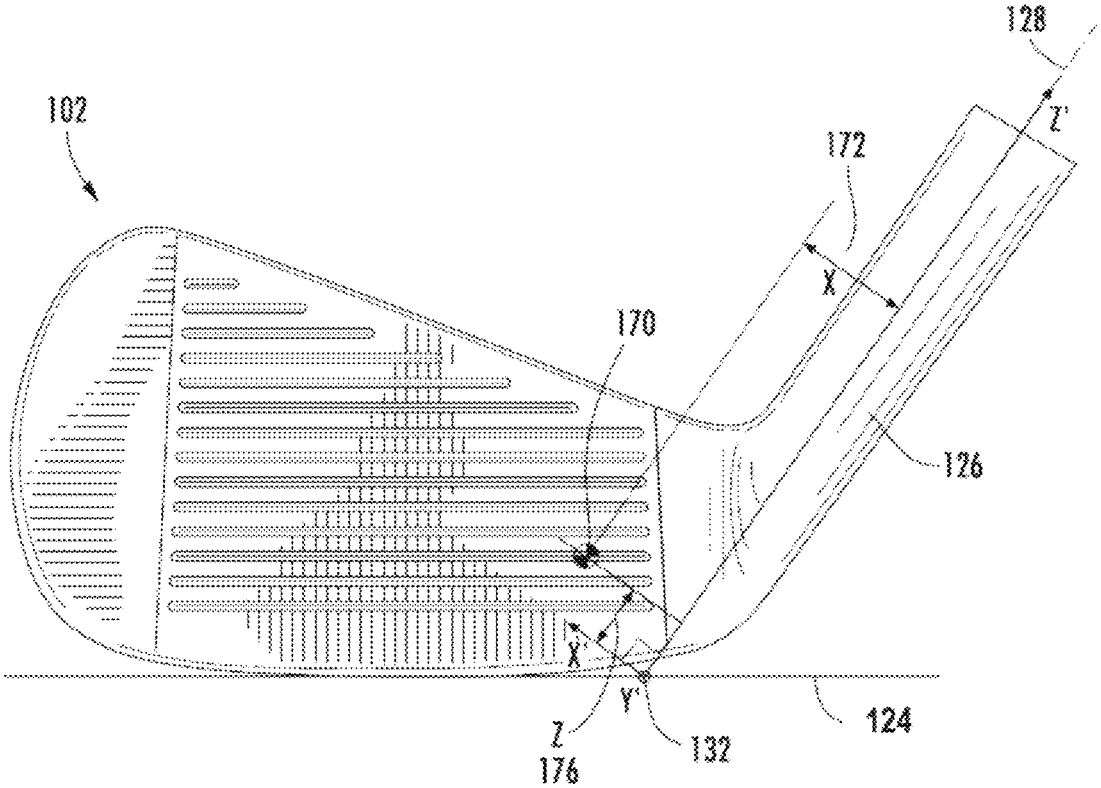
Figure 7B:
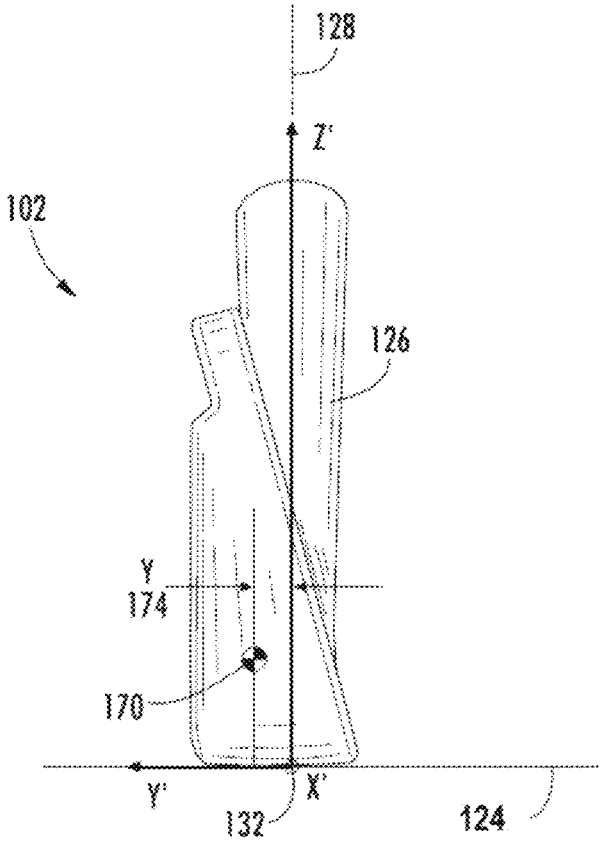

FIGS. 7A and 7B illustrate an example of a center of gravity location 170 as a specified parameter of the golf club head 102. The center of gravity of the golf club head 102 may be determined using various methods and procedures known and used in the art. The golf club head 102 center of gravity location 170 is provided with reference to its position from the origin point 132. As illustrated in FIGS. 7A and 7B, the center of gravity location 170 is defined by a distance from the origin point 132 along the X' axis 172, Y' axis 174, and Z' axis 176.

FIGS. 3-7B illustrate a golf club head 102 oriented in a reference position. In the reference position, the hosel axis 128 or shaft axis lies in a vertical plane as shown in FIG. 5. As illustrated in FIG. 3, the hosel axis 128 may be oriented at a lie angle 130. The lie angle selected for the reference position may be the golf club 100 manufacturer's specified lie angle. If a specified lie angle is not available from the manufacturer, a lie angle of as specified by the golf club manufacturer may be used, depending on shaft length and/or club head geometry, as would be understood by one of ordinary skill in the art. Furthermore for the reference position, as illustrated in FIG. 5, the striking face 110 may be oriented at a loft angle 150. The loft angle selected for the reference position may be the golf club manufacturer's specified loft angle. Table 1, below, provides exemplary loft and lie angles for various blade-type iron golf club heads in accordance with an embodiment of this invention.

TABLE 1 a. Example Loft and Lie Angle for a Blade-Type Iron Club Heads

| Blade-Type Iron Golf Club Head | Loft Angle | Lie Angle |
|---|---|---|
| #2 | 18.0° | 59.0° |
| #3 | 21.0° | 59.0° |
| #4 | 24.0° | 60.0° |
| #5 | 27.0° | 61.0° |
| #6 | 31.0° | 62.0° |
| #7 | 35.0° | 62.5° |
| #8 | 39.0° | 63.0° |
| #9 | 43.0° | 63.5° |
| PW | 47.0° | 64.0° |

Club head parameters or characteristics may be measured physically, or in a computer-aided-design (CAD) environment. Generally, if a 3 dimensional (3D) model of club head 102 is not readily available, one may be created by performing a 3D scan of the interior and exterior of a physical example of the club head 102 and creating a model file from the scan data and/or physical measurements, such that the model is substantially representative of the physical club head. In the CAD environment, the model of club head 102 may be set in the reference position with the face 110 oriented at the manufacturer's loft angle within the CAD environment such that the model is fully constrained.

Additionally, the golf club 100 may be physically oriented in the reference position using a fixturing system known and used in the art. As was described above, the shaft axis may be aligned at a lie angle according to the golf club manufacturer's specification, or at an appropriate lie angle as determined by one of skill in the art. The golf club head 102 may rest with its sole 114 contacting a horizontal surface 124 with the club face 110 positioned at the manufacturer's face angle and/or loft angle using conventional loft and face angle measurement gauges known to one of skill in the art.

Figure 8:
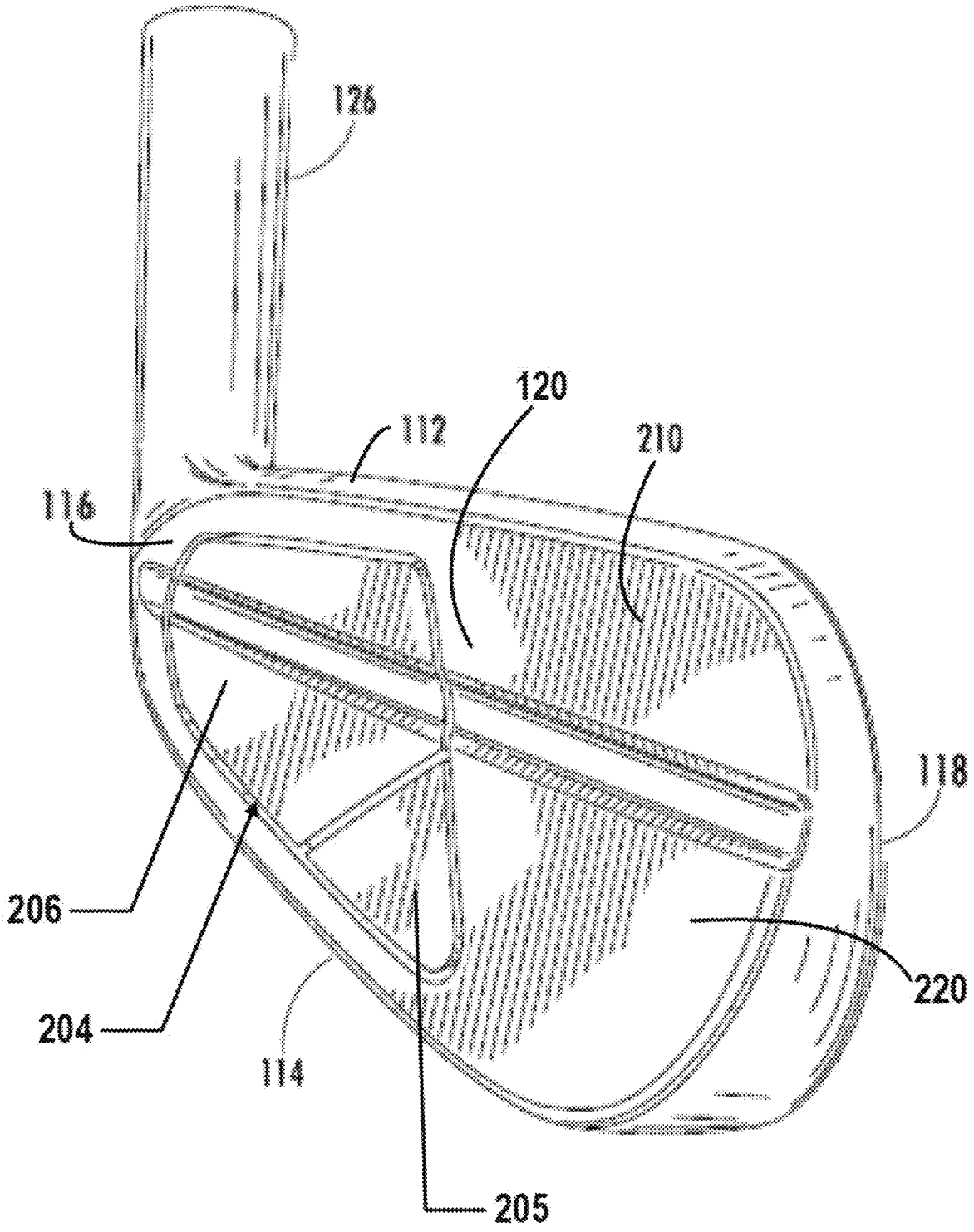
FIG. 8 illustrates a perspective rear view of the golf club head illustrated in FIGS. 3 through 7B with the addition of an insert located behind the ball striking surface according to this invention.
Figure 9:
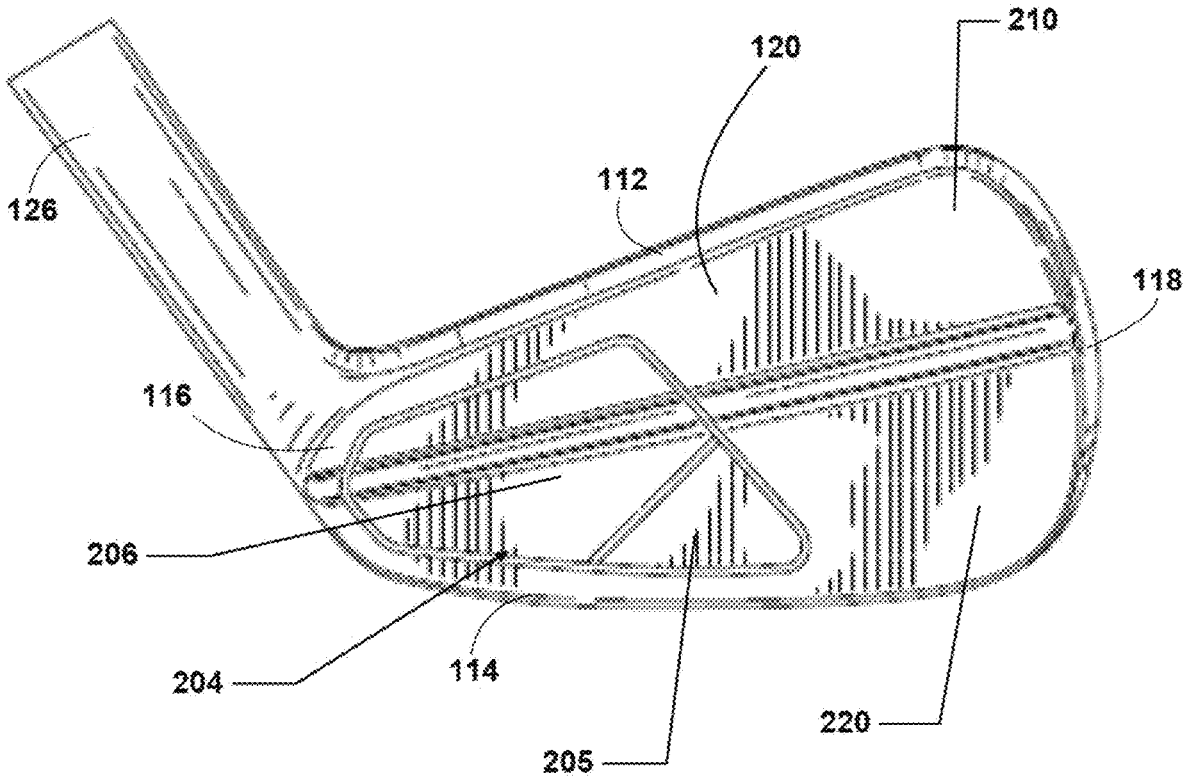
FIG. 9 illustrates a rear view of the golf club head illustrated in FIGS. 3A through 7B with the addition of an insert located behind the ball striking surface according to this invention.
Figure 10A:
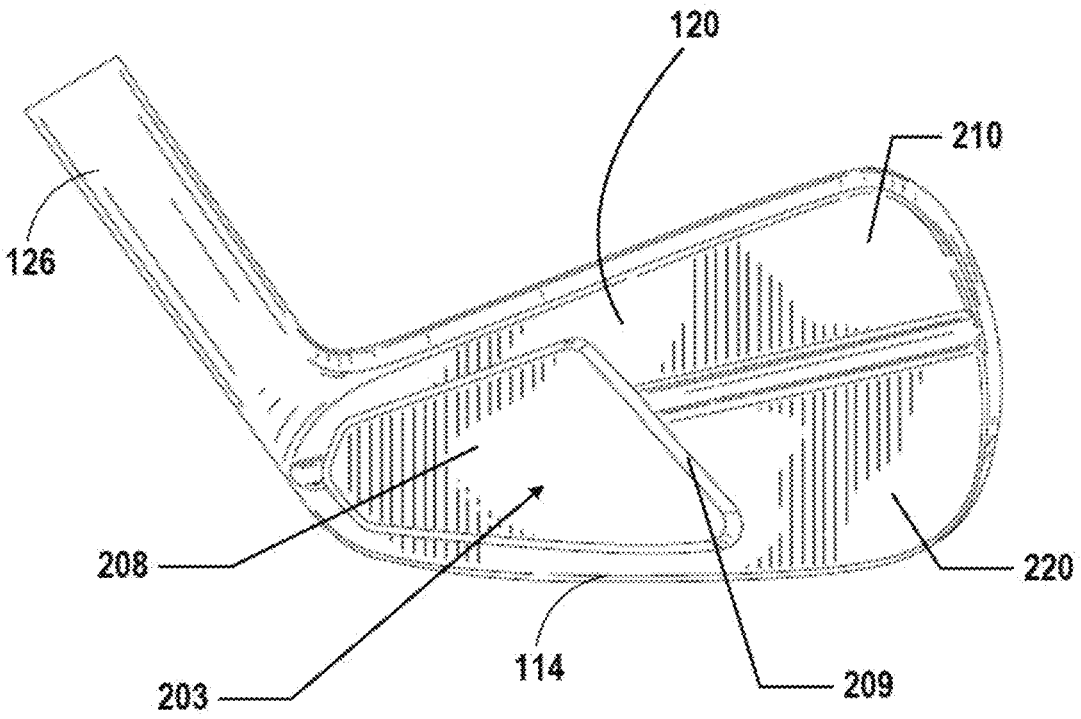
FIGS. 10A and 10B are a schematic cross-sectional view taken through FIG. 9 with the dual-density insert structure removed for clarity.
Figure 10B:
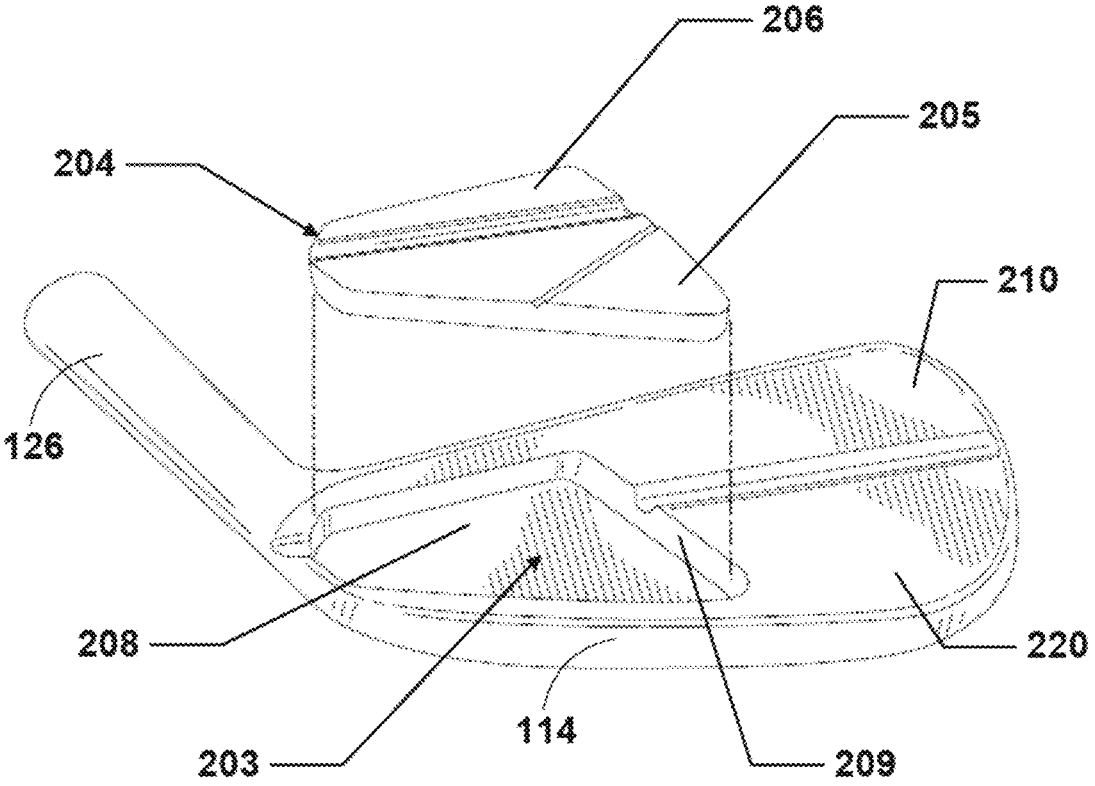

The present invention provides a blade-type or muscle-back iron club head. FIGS. 8 through 10B illustrate a blade-type iron club head in accordance with aspects of this invention. FIG. 8 illustrates a perspective rear view of the golf club head 102. FIG. 9 illustrates a rear view of the golf club head 102. FIG. 10A illustrates a schematic cross-sectional view taken through FIG. 9 with the dual-density insert structure removed. FIG. 10B illustrates a schematic cross-sectional view taken through FIG. 9 with the dual-density insert structure displaced and shown above the insert recess.

According to certain aspects, a blade-type gold club may include a dual-density insert. The dual-density insert may include a first insert provided with a higher density than the remainder of the insert and a second insert provided with a lower density than the remainder of the insert and/or club head. The dual-density insert may include a first insert and a second insert located adjacent and contiguous with each other, with the first insert having a higher density and the second insert have a lower density than the first insert. Further, the higher density portion or insert of a dual-density insert may be located behind at least a portion of the point-of-impact region or a center of gravity of an iron-type golf club, with the majority of the volume of the lower dense portion or insert being located toe-most within the rear surface of the club head. The dual-density insert may provide displacement of the center of gravity of the golf club head to be substantially coincident with the geometric center and/or the center of gravity of the golf club head.

As described above, the club head 102 includes a face or striking face 110, a top surface 112, a sole 114, a heel 116, a toe 118, and a rear surface 120. The rear surface 120 comprises a substantially flat area, which defines a blade portion 210 of the club head 102, and a thickened area which defines a muscle portion 220 of the club head 102. The blade portion 210 generally occupies the entire upper portion of the club head 102, and has a substantially constant thickness that may be less than, for example, about 6.4 mm. The muscle portion 220 generally constitutes a lower portion of the club head 102, and has a varying thickness that is everywhere greater than that of blade portion 210. As understood by those of skill of the art, the club head 102 may be a blade-type iron with no muscle portion 220, wherein the blade portion 210 occupies the entire rear surface 120 of the club head 102.

As illustrated in FIGS. 8 through 10B, the dual-density insert 204 adds mass and material closer to the sole 114 and toe 118. The dual-density insert 204 may include a first insert 205 and a second insert 206. The first insert 205 and the second insert 206 may be located adjacent and contiguous with each other. The first insert 205 may have a higher density than the second insert 206, thus making the first insert 205 heavier than the second insert 206. The dual-density insert 204, along with the first insert 205 and second insert 206, causes a displacement of the center of gravity of the club head 102 to be substantially coincident with the geometric center of the striking face 110. The first insert 205 as the more dense insert may have the majority of the first insert's volume being located behind at least a portion of the point-of-impact region or a center of gravity of the rear surface 120 and within the recess 203. The second insert 206 as the less dense insert may have the majority of the second insert's volume being located toe-most of the rear surface 120 and within the recess 203.

For most conventional blade-type irons (as illustrated in FIGS. 2A, 2B and 11-17J), the center of gravity 170 is located on the heel and sole side of the face center location 140 and approximately 2 mm away from the face center 140 location. For the club heads 102 in accordance with aspects of this invention with the mass distribution dual-density insert 204, the center of gravity 170 moves towards the toe and top surface of the club head and approximately 0.5 to 0.7 mm closer to the face center location 140. This mass distribution and center of gravity displacement is an approximate 25% to 35% change in the location of the center of gravity 170 with respect to the face center 140, moving the center of gravity 170 25-35% closer to the face center 140 as compared to the conventional blade-type irons.

The dual-density insert 204 may weigh between 20 and 70 grams. Additionally, the first insert or first portion 205 may weigh between 12 and 66 grams, while the second insert or second portion 206 (lighter weight portion) may weigh between 4 and 10 grams. The density of the first insert or first portion 205 may be between 10 and 17 grams/cm$^3$, while the density of the second insert or second portion 206 may be between 1 and 3 grams/cm$^3$.

As illustrated in FIGS. 8 through 10B, the dual-density insert 204 may fit or be located in a rear recess 203. According to certain aspects, one or more recesses 203 may be provided on the rear surface 120 of the club head 102. The dual-density insert 204 may be composed of a first insert 205 and a second insert 206. The first insert 205 may have a higher density than the second insert 206. Additionally, the first insert 205 may have a heavier weight than the second insert 206. Lastly, the first insert 205 may have a larger volume than the second insert 206. The first insert 205 and heavier density insert of the dual-density insert 204 may be located behind and closer to the face center location 140 than the second insert 206 and lighter density insert.

In certain example embodiments, as illustrated in FIGS. 8 and 9, the dual-density insert 204, first portion 205, and/or second portion 206 may be flush with or continuous with the rear surface 120 of the club head 102. Additionally, the rear surface 120 of the club head 102 may include contouring. The dual-density insert 204, first portion 205, and/or second portion 206 may be flush with or continuous with the contouring of the rear surface 120 of the club head 102.

In certain example embodiments, at least a portion of the second insert 206 may be formed of a material having a lesser density than the material used to form the first insert 205. Thus, for example, the lesser density portion of the second insert 206 may be formed of a high-strength stainless steel (or alternatively, a titanium alloy), or high-strength plastics or composites. The higher density portion of the first insert 205 may be formed of a tungsten or lead material. It is understood that the dual-density insert 204, the first insert 205, or the second insert 206 may be formed of a combination of several different materials or may be formed of a single material.

Additionally, as noted above, the dual-density insert 204, the first insert 205, or the second insert 206 may be formed by any of various manufacturing methods. For example, inserts including metals (such as titanium, aluminum, titanium alloys, aluminum alloys, steels (such as stainless steels), and the like) may be formed by forging, molding, casting, stamping, machining, and/or other known techniques. In another example, inserts formed of composite materials, such as carbon fiber-polymer composites, can be manufactured by a variety of composite processing techniques, such as pre-preg processing, powder-based techniques, mold infiltration, and/or other known techniques. Also, as noted above, if desired, the dual-density insert 204, the first insert 205, or the second insert 206 may be made from any number of pieces (e.g., having a separate perimeter, upper region, lower layer, etc.) and/or by any construction technique, including, for example, casting, injection molding, compression molding, laminating, 3-D printing, and/or other methods known and used in the art.

As illustrated in FIGS. 8 through 10B, the dual-density insert 204, the first insert 205, or the second insert 206 may be integrally joined to the rear recess 203. "Integral joining" is a technique for joining two pieces so that the two pieces effectively become a single, integral piece, including, but not limited to, irreversible joining techniques, such as adhesively joining, cementing, welding, brazing, soldering, or the like. In many bonds made by "integral joining," separation of the joined pieces cannot be accomplished without structurally damaging one or both of the joined pieces.

According to certain aspects, adhesive members may include liquid-type adhesives (such as epoxies, glues, cements, putties, pastes, etc.) to affix dual-density insert 204, the first insert 205, or the second insert 206 to the ball striking surface 110. Liquid-type adhesive refers to an adhesive that flows and thereby readily assumes the shape of the regions to which is applied. For example, such an adhesive member may be used to affix the insert directly to the floor and/or perimeter edges of the recess. Further, such an adhesive member may provide a permanent attachment or a non-permanent attachment of the insert to the recess.

Alternatively, or additionally, other means for affixing the dual-density insert 204, the first insert 205, or the second insert 206 in the recess 203 behind the ball striking surface 110 may be employed, including press fits, interference fits, snap fits, thermal fits, mechanical fasteners, including threaded screws and non-threaded pins, clasps, etc. In still other embodiments, the dual-density insert 204, the first insert 205, or the second insert 206 may be formed in place, i.e., by molding (including co-molding and over-molding, casting, etc.).

In general, the recess 203 and dual-density insert 204, the first insert 205, or the second insert 206 may assume any size or shape. For example, the perimeter edge of the recess may be generally rectangular, triangular, trapezoidal, polygonal (with or without rounded corners and/or with straight edges or with curved edges), circular, oval, elliptical, tear-drop shaped, pear shaped. Even further, the recess 203 and the dual-density insert 204, the first insert 205, or the second insert 206 need not have a regular geometric shape, nor need it be symmetrically shaped. Thus, for example, the recess 203 and the dual-density insert 204, the first insert 205, or the second insert 206 may have a plurality of sides of varying lengths and/or curvatures. Optionally, the recess 203 and the dual-density insert 204, the first insert 205, or the second insert 206 may have an amorphous, curved, amoeba-like shape.

According to some aspects, the rear surface 120 may include multiple recesses. For example, the rear surface 120 may include a first recess and a second recess. The first recess may receive the first insert 205 and the second recess may receive the second insert 206. The first recess and first insert 205 may be located near or adjacent to the center of the face or the toe-side of the club head 102. The second recess and second insert 206 may be located near or adjacent to the heel-side of the club head 102. Additional recesses with additional inserts may be utilized without departing from this invention.

According to some aspects, the recess 203 may have a generally constant depth. Thus, the recess 203 may have a floor 208 that is substantially planar and perimeter walls 209 of substantially constant height. In certain embodiments, the depth of the recess 203 need not be constant. For example, the recess floor 208 may be stepped, faceted, convexly domed, concave, etc. Further, the recess 203 may have a floor 208 that is substantially planar, but angled (or slanted) such that one portion of the recess 203 is deeper than another portion. Thus, the perimeter walls 209 may have a varying height.

According to some aspects, the recess 203 may have a maximum depth of approximately 1.0 mm to approximately 4.5 mm. These example depths may be particularly appropriate for golf club ball striking surfaces 110 formed of metal (i.e., titanium alloys, stainless steel, etc.). More typically, the recess 203 may have a maximum depth of approximately 1.5 mm to approximately 4.0 mm. Alternatively, the recess 203 may have a maximum depth of approximately 2.0 mm to approximately 4.0 mm, a maximum depth of approximately 2.0 mm to approximately 3.5 mm, or even a maximum depth of approximately 2.0 mm to approximately 3.25 mm. As noted above, this depth may be substantially constant in the recess 203.

Additionally, the dual-density insert 204, the first insert 205, or the second insert 206 may have a maximum thickness of approximately 1.0 mm to approximately 4.5 mm. These example thicknesses may be particularly appropriate for golf club ball striking surfaces 110 formed of metal (i.e., titanium alloys, stainless steel, etc.). More typically, the dual-density insert 204, the first insert 205, or the second insert 206 may have a maximum thickness of approximately 1.5 mm to approximately 4.0 mm. Alternatively, the dual-density insert 204, the first insert 205, or the second insert 206 may have a maximum thickness of approximately 2.0 mm to approximately 4.0 mm, a maximum thickness of approximately 2.0 mm to approximately 3.5 mm, or even a maximum thickness of approximately 2.0 mm to approximately 3.25 mm. As noted above, this thickness may be substantially constant for each of the dual-density insert 204, the first insert 205, or the second insert 206.

In general, the recess 203 and the dual-density insert 204, the first insert 205, or the second insert 206 may be located anywhere on the rear surface of the ball striking surface 110. Thus, for example, for golf club heads, a majority of the recess 203 and the dual-density insert 204, the first insert 205, or the second insert 206 may be located to the heel-side of the center of the club face. According to certain embodiments, the recess 203 and the dual-density insert 204, the first insert 205, or the second insert 206 may extend closer to the toe-side of the club head 102 in the lower half of the ball striking device (i.e., below the center of the club face) than in the upper half of the ball striking device (i.e., above the center of the club face). Optionally, the recess 203 and the dual-density insert 204, the first insert 205, or the second insert 206 may be symmetrical with respect to a vertical line extending through the center of the club face and/or symmetrical with respect to a horizontal line extending through the center of the club face.

The dual-density insert 204, the first insert 205, or the second insert 206 may have an evenly distributed weight profile, such that the areal density (i.e., weight per unit area) is constant. As such, the areal centroid of the dual-density insert 204, the first insert 205, or the second insert 206 would coincide with the center of gravity of the dual-density insert 204, the first insert 205, or the second insert 206. For example, the dual-density insert 204, the first insert 205, or the second insert 206 may have a constant thickness and a constant material density. As another example, the dual-density insert 204, the first insert 205, or the second insert 206 may be formed of a single material, but may have different thicknesses in certain regions; such a first, thicker region of the insert may have a greater areal density (i.e., weight per unit area) than a second, thinner region. In other words, the dual-density insert 204, the first insert 205, or the second insert 206 may be weighted more to one side than the other.

Further, according to certain aspects, the dual-density insert 204, the first insert 205, or the second insert 206 may completely fill the volume of the recess 203. For example, the exposed surface of the dual-density insert 204, the first insert 205, or the second insert 206 may lie flush with the rear surface of the ball striking surface 110, the perimeter of the dual-density insert 204, the first insert 205, or the second insert 206 may complementarily match the perimeter edge of the recess 203, and the dual-density insert 204, the first insert 205, or the second insert 206 may be solid with no internal voids or cavities. According to other embodiments, the dual-density insert 204, the first insert 205, or the second insert 206 may only partially fill the recess 203. For example, the perimeter of the dual-density insert 204, the first insert 205, or the second insert 206 may complementarily match the perimeter edge of the recess 203, but the dual-density insert 204, the first insert 205, or the second insert 206 may be thinner than the height of the perimeter walls of the recess 203 such that the dual-density insert 204, the first insert 205, or the second insert 206 lies below, and is not flush with, the rear surface of the ball striking device. Optionally, the exposed surface of the dual-density insert 204, the first insert 205, or the second insert 206 may be flush with the rear surface of the ball striking device, but the perimeter of the dual-density insert 204, the first insert 205, or the second insert 206 may not complementarily match the perimeter edge of the recess 203. Even further, the dual-density insert 204, the first insert 205, or the second insert 206 may appear to fill the recess 203 (due to the exposed surface of the dual-density insert 204, the first insert 205, or the second insert 206 lying flush with the rear surface of the ball striking surface and the perimeter of the insert complementarily matching the perimeter edge of the recess), but the dual-density insert 204, the first insert 205, or the second insert 206 may be formed with internal voids and/or cavities such that the volume of material forming the dual-density insert 204, the first insert 205, or the second insert 206 is less than the overall volume of the recess 203. According to even other embodiments, the entire dual-density insert 204, the first insert 205, or the second insert 206, or portions thereof, may extend beyond or project from the rear surface of the ball striking device.

According to even other aspects, more than one dual-density insert 204, the first insert 205, or the second insert 206 may be a received within the recess 203 or a portion of the recess 203. For example, a first portion of the dual-density insert 204, the first insert 205, or the second insert 206 may cover the floor 208 of the recess 203 and a second portion of the dual-density insert 204, the first insert 205, or the second insert 206 may extend over the first portion of the dual-density insert 204, the first insert 205, or the second insert 206, such that the two portions of the dual-density insert 204, the first insert 205, or the second insert 206, combined, completely fill the recess 203. Other variations, whereby the portions of the dual-density insert 204, the first insert 205, or the second insert 206 may be positioned side-by-side in the recess 203, whereby the portions of the dual-density insert 204, the first insert 205, or the second insert 206, combined, only partially fill the recess 203, etc., would be apparent to a person of ordinary skill in the art, given the benefit of this disclosure.

From the above disclosure it may be recognized that any of many different variations of the configuration of the recess 203 and the configuration of the dual-density insert 204, the first insert 205, or the second insert 206 may be provided such that the club head mass characteristics (e.g., moment-of-inertia, center-of-gravity, etc.), the club head dynamic characteristics (e.g., vibration characteristics, both feel and sound), and/or ball striking surface characteristics (e.g., coefficient of restitution, stress and strain characteristics, etc.), may be altered and/or controlled.

Benefits

Embodiments of this invention present many benefits to the golf industry and the different participants in the golf industry.

First, the mass distribution of the dual-density insert moves the center of gravity of the club head closer to the face center location. As was described above, for most conventional blade-type irons, the center of gravity is located to the heel side and sole side of the face center location and approximately 2 mm away from the face center location. For the club heads in accordance with aspects of this invention with the dual-density insert, the center of gravity moves towards the toe and top surface of the club head and approximately 0.5 to 0.7 mm closer to the face center location. This is an approximate 25% to 35% change in the location of the center of gravity with respect to the face center, moving the center of gravity 25-35% closer to the face center as compared to the conventional blade-type irons. Table 2 below shows the displacement of the center of gravity of the head closer to the face center location and substantially coincident with the face center location.

TABLE 2 a. Example Club Heads According these Embodiments

| Club (of these embodiments) | Face Ht | CoF Ht | CG Ht | CoF X | CG X |
|---|---|---|---|---|---|
| Example Club head #1 | 1.913 | 0.819 | 0.723 | 1.202 | 1.218 |
| Example Club head #2 | 1.915 | 0.825 | 0.735 | 1.178 | 1.197 |

As illustrated above, the face center location is substantially coincident with the center of gravity location for both the exemplary club head #1 and exemplary club head #2. For example, the face center height (CoF Ht) and center of gravity height (CG Ht) for the exemplary club head #1 is 0.819 mm and 0.723 mm respectively, while the face center x-location (CoF X) and center of gravity x-location (CG X) for the exemplary club #1 is 1.202 mm and 1.218 mm respectively. Additionally, the face center height (CoF Ht) and center of gravity height (CG Ht) for the exemplary club head #2 is 0.825 mm and 0.735 mm respectively, while the face center x-location (CoF X) and center of gravity x-location (CG X) for the exemplary club #2 is 1.178 mm and 1.197 mm respectively.

CONCLUSION

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

I claim:

1. An iron-type golf club head comprising:

a top surface adjacent and above a ball striking surface configured for striking a ball, wherein the top surface defines an upper portion of the iron-type golf club head, a sole adjacent the ball striking surface and opposite the top surface, a heel side near a hosel, and a toe side opposite the hosel, the top surface having a width within a range of 6 mm and 8 mm and the sole having a width within a range of 8 mm and 16 mm; and a rear surface opposite the ball striking surface having an upper blade portion, a blade interface portion, and a lower muscle portion, wherein the upper blade portion is adjacent to the top surface and extends across the rear surface from the heel side of the rear surface to the toe side of the rear surface and further extends downward from the top surface to the blade interface portion, wherein the blade interface portion extends across the rear surface from the heel side of the rear surface to the toe side of the rear surface and is a smooth arcuate surface extending between and in direct contact with both the upper blade portion and the lower muscle portion, wherein the lower muscle portion extends across the rear surface from the heel side of the rear surface to the toe side of the rear surface and the lower muscle portion extends upward from the sole to the blade interface portion, and wherein the lower muscle portion has a thickness greater than the upper blade portion, wherein the upper blade portion has a substantially constant thickness;

a recess provided in the rear surface;

wherein the recess comprises a recess floor that is substantially planar;

wherein the recess floor is angled such that one portion of the recess is deeper than another portion of the recess;

wherein the recess comprises a perimeter wall;

wherein the perimeter wall comprises a perimeter wall height;

wherein the perimeter wall height varies;

and an insert received within the recess;

wherein the insert consists of at least two metallic materials;

wherein the insert is affixed within the recess by means of welding or brazing;

wherein at least a portion of the recess extends behind a location of a center of gravity of the iron-type golf club head, wherein the insert has a first portion having a first density and a second portion having a second density which is less than the first density, wherein the first portion and the second portion are located adjacent and contiguous to each other, and wherein the first portion of the insert is located entirely within the lower muscle portion and the second portion is located within the upper blade portion, the blade interface portion, and the lower muscle portion.

2. The iron-type golf club head of claim 1, wherein the insert is affixed to the recess in the rear surface opposite the ball striking surface behind a point-of-impact region.

3. The iron-type golf club head of claim 1, wherein the insert completely fills the recess.

4. The iron-type golf club head of claim 1, wherein the insert displaces the location of the center of gravity of the iron-type golf club head to be substantially coincident with a location of a center of the ball striking surface.

5. The iron-type golf club head of claim 1, wherein the insert weighs between approximately 20 and 70 grams with the first portion weighing between approximately 12 and 66 grams and the second portion weighing between 4 and 10 grams.

6. The iron-type golf club head of claim 1, wherein the insert is further affixed to the recess in the rear surface opposite the ball striking surface with an adhesive member.

7. The iron-type golf club head of claim 1, wherein the insert has a perimeter that complementarily matches a perimeter edge of the recess.

8. The iron-type golf club head of claim 1, wherein both the first portion of the insert and the second portion of the insert are flush with the rear surface of the iron-type golf club head.

9. A blade-type iron golf club comprising:

a blade-type golf club head comprising a body forged of a metal material, the body having a hosel, a ball striking surface configured for striking a ball, a top surface adjacent and above the ball striking surface, wherein the top surface defines an upper portion of the blade-type golf club head, a sole adjacent the ball striking surface opposite the top surface, a heel side near the hosel, and a toe side opposite the heel side, the blade-type golf club head further comprising a rear surface opposite the ball striking surface, the rear surface having a recess, an upper blade portion, a blade interface portion, a lower muscle portion, wherein the lower muscle portion has a thickness greater than the upper blade portion and wherein the upper blade portion has a substantially constant thickness; and wherein the recess comprises a recess floor that is substantially planar;

wherein the recess floor is angled such that one portion of the recess is deeper than another portion of the recess;

wherein the recess comprises a perimeter wall;

wherein the perimeter wall comprises a perimeter wall height;

wherein the perimeter wall height varies;

an insert received within the recess, wherein the insert consists of at least two metallic materials;

wherein the insert is affixed within the recess by means of welding or brazing;

wherein at least a portion of the recess extends behind a center of gravity of the blade-type golf club head, and wherein the insert has a first portion having a first density and a second portion having a second density which is less than the first density, wherein the first portion and the second portion are located adjacent and contiguous to each other, wherein the first portion of the insert is located entirely within the lower muscle portion and the second portion is located within the upper blade portion, the blade interface portion, and the lower muscle portion, wherein the lower muscle portion extends across the rear surface from the heel side of the rear surface to the toe side of the rear surface and the lower muscle portion extends upward from the sole to the blade interface portion, wherein the upper blade portion extends across the rear surface from the heel side of the rear surface to the toe side of the rear surface and extends downward from the top surface to the blade interface portion, wherein the blade interface portion extends across the rear surface from the heel side of the rear surface to the toe side of the rear surface and is a smooth arcuate surface extending between and in direct contact with both the upper blade portion and the lower muscle portion; and a shaft that attaches to the blade-type golf club head at the hosel.

10. The blade-type iron golf club of claim 9, wherein the insert is affixed to the recess in the rear surface opposite the ball striking surface behind a point-of-impact region.

11. The blade-type iron golf club of claim 9, wherein the insert displaces a location of the center of gravity of the blade-type golf club head to be substantially coincident with a location of a center of the ball striking surface.

12. The blade-type iron golf club of claim 9, wherein the insert weighs between approximately 20 and 70 grams with the first portion weighing between approximately 12 and 66 grams and the second portion weighing between 4 and 10 grams.

13. The blade-type iron golf club of claim 9, wherein the insert extends over a majority of the rear surface of the ball striking surface, and wherein both the first portion of the insert and the second portion of the insert are flush with the rear surface of the blade-type golf club head.

14. A blade-type iron golf club comprising:

a blade-type golf club head comprising a body having a ball striking surface, a hosel, a top surface adjacent and above the ball striking surface, wherein the top surface defines an upper portion of the blade-type golf club head, a sole adjacent the ball striking surface opposite the top surface, a heel side near the hosel, and a toe side opposite the heel side, the blade-type golf club head further comprising a rear surface opposite the ball striking surface, the rear surface having a recess, an upper blade portion, a blade interface portion, a lower muscle portion, wherein the lower muscle portion has a thickness greater than the upper blade portion and wherein the upper blade portion has a substantially constant thickness; and wherein the recess comprises a perimeter wall;

wherein the perimeter wall comprises a perimeter wall height;

wherein the perimeter wall height varies;

wherein the recess comprises a depth;

wherein the recess has a floor that is stepped such that the depth of the recess varies;

an insert received within the recess, wherein the insert consists of at least two metallic materials;

wherein the insert is affixed within the recess by means of welding or brazing;

wherein the insert has a first portion having a first density and a second portion having a second density which is less than the first density, wherein the first portion of the insert is formed from a density greater than 11 $g/cm^3$, wherein the insert displaces a location of a center of gravity of the blade-type golf club head to be substantially coincident with a location of a center of the ball striking surface in a heel-to-toe direction;

wherein the first portion of the insert is located entirely within the lower muscle portion and the second portion is located within the upper blade portion, the blade interface portion, and the lower muscle portion, wherein the lower muscle portion extends across the rear surface from the heel side of the rear surface to the toe side of the rear surface and the lower muscle portion extends upward from the sole to the blade interface portion, wherein the upper blade portion extends across the rear surface from the heel side of the rear surface to the toe side of the rear surface and extends downward from the top surface to the blade interface portion, wherein the blade interface portion extends across the rear surface from the heel side of the rear surface to the toe side of the rear surface and is a smooth arcuate surface extending between and in direct contact with both the upper blade portion and the lower muscle portion; and a shaft that attaches to the blade-type golf club head at the hosel.

15. The blade-type iron golf club of claim 14, wherein the first portion and the second portion are located adjacent and contiguous to each other.

16. The blade-type iron golf club of claim 14, wherein the second portion of the insert has a majority of its volume located on the heel side of the rear surface.

17. The blade-type iron golf club of claim 14, wherein at least a portion of the recess extends behind the center of gravity of the blade-type golf club head.

18. The blade-type iron golf club of claim 14, wherein the insert is affixed to the recess in the rear surface opposite the ball striking surface behind a point-of-impact region.

19. The blade-type iron golf club of claim 14, wherein both the first portion of the insert and the second portion of the insert are flush with the rear surface of the blade-type golf club head.

20. The blade-type iron golf club of claim 14, wherein the insert weighs between approximately 20 and 70 grams with the first portion weighing between approximately 12 and 66 grams and the second portion weighing between 4 and 10 grams.

* * * * *